US009021734B2

(12) United States Patent
Voigt

(10) Patent No.: US 9,021,734 B2
(45) Date of Patent: May 5, 2015

(54) FOLDING FIREARM

(71) Applicant: Aaron Voigt, Asheville, NC (US)

(72) Inventor: Aaron Voigt, Asheville, NC (US)

( * ) Notice: Subject to any disclaimer, the term of this patent is extended or adjusted under 35 U.S.C. 154(b) by 0 days.

(21) Appl. No.: 14/286,519

(22) Filed: May 23, 2014

(65) Prior Publication Data

US 2014/0352190 A1 Dec. 4, 2014

Related U.S. Application Data

(60) Provisional application No. 61/830,084, filed on Jun. 1, 2013.

(51) Int. Cl.

| | |
|---|---|
| ***F41A 11/04*** | (2006.01) |
| ***F41C 23/04*** | (2006.01) |
| ***F41C 23/14*** | (2006.01) |

(52) U.S. Cl.

CPC ..... *F41C 23/14* (2013.01); *F41A 11/04* (2013.01)

(58) Field of Classification Search

CPC ..... F41A 11/00; F41A 11/02; F41A 11/04; F41C 23/00; F41C 23/04; F41C 23/12

USPC ..... 42/75.04

See application file for complete search history.

(56) References Cited

U.S. PATENT DOCUMENTS

| | | | | |
|---|---|---|---|---|
| 521,202 | A * | 6/1894 | Burgess | 42/71.01 |
| 562,487 | A * | 6/1896 | Quackenbush | 42/72 |
| 652,583 | A * | 6/1900 | Baird | 42/71.01 |
| 1,588,887 | A * | 6/1926 | Haubroe | 42/75.03 |
| 3,020,662 | A * | 2/1962 | Merkel | 42/11 |
| 3,861,273 | A * | 1/1975 | Seidel et al. | 89/129.02 |
| 4,271,623 | A * | 6/1981 | Beretta | 42/72 |
| 4,299,046 | A * | 11/1981 | Atchisson | 42/75.04 |
| 4,625,621 | A * | 12/1986 | Warin | 89/197 |
| 5,924,233 | A * | 7/1999 | Strobel | 42/72 |
| 7,191,775 | B1 * | 3/2007 | Lo | 124/65 |
| 7,322,142 | B1 * | 1/2008 | Leung | 42/71.01 |
| 7,941,954 | B2 * | 5/2011 | Carr et al. | 42/36 |
| 8,438,771 | B1 * | 5/2013 | Boone | 42/72 |
| 8,677,669 | B1 * | 3/2014 | Vesligaj | 42/75.01 |
| 2013/0047482 | A1 * | 2/2013 | Mulfinger | 42/84 |
| 2014/0053447 | A1 * | 2/2014 | Singh | 42/71.02 |
| 2014/0075802 | A1 * | 3/2014 | Dubois et al. | 42/16 |

OTHER PUBLICATIONS

Chris Eger, 4 Foldable Submachine Guns, http://www.guns.com/2013/02/08/foldable-submachine-guns.

(Continued)

*Primary Examiner* — Bret Hayes
*Assistant Examiner* — Derrick Morgan
(74) *Attorney, Agent, or Firm* — Bennet K. Langlotz; Langlotz Patent & Trademark Works, Inc.

(57) ABSTRACT

Folding firearms have a first portion including a shoulder stock having a free end butt surface and a trigger assembly including a trigger lever, a second portion including a frame defining a bolt passage, a bolt received in the bolt passage, and a barrel connected to the frame, and the first portion and second portion being pivotally connected to each other to pivot about a pivot axis between an operating position in which the barrel extends in a first direction and the shoulder stock extends in an opposite direction, and a folded position in which the barrel and shoulder stock extend in a common direction. The pivot axis may be perpendicular to a bore axis defined by the barrel, and oriented parallel to a medial plane defined by the firearm, the medial plane being vertical during normal firearm operation.

27 Claims, 18 Drawing Sheets

(56) References Cited

OTHER PUBLICATIONS

Richard L. Johnson, Folding Rifles in Pistol Calibers, http://www.humanevents.com/2013/01/06/folding-rifles-in-pistol-calibers.

Mark, Chiappa Little Badger Folding Rifle .22LR—$149.99 + Free Shipping, http://www.slickguns.com/product/chiappa-little-badger-folding-rifle-221r-16979-shipped.

* cited by examiner

FOLDING FIREARM

CROSS-REFERENCE TO RELATED APPLICATION

This application claims the benefit of U.S. Provisional Application No. 61/830,084, filed on Jun. 1, 2013, entitled "FLAT-FOLDING LONG GUN," which is hereby incorporated by reference in its entirety for all that is taught and disclosed therein.

FIELD OF THE INVENTION

The present invention relates to firearms, and more particularly to lightweight firearms that can be folded into an ergonomic, compact shape about a vertical pivot axis.

BACKGROUND OF THE INVENTION

Folding firearms are desirable because they are convenient to carry and easy to conceal. A variety of firearms have been developed that fold in half about a horizontal pivot axis. An example of a single barrel foldable rifle is the Little Badger Folding Rifle that fires .22LR cartridges manufactured by Chiappa Firearms of Dayton, Ohio. Several foldable submachine guns that fold into substantially rectangular box shapes have been developed, including U.S. Pat. No. 4,625,621 to Warin, the UC-9 and M-21 folding submachine guns manufactured by Utah Connor and Dave Boatman, the Russian PP-90 and the Ukrainian Goblin, and the FMG-9 manufactured by Magpul Industries of Boulder, Colo. An example of a folding rifle that shoots pistol caliber cartridges (either 9 mm or .40 S&W) is the SUB-2000 manufactured by Kel-Tec of Cocoa, Fla. Several of these firearms have the disadvantage of being class III firearms due to their barrel length or full auto action. Few of these firearms have ever gone into significant production, making them curiosities rather than commercial successes.

Therefore, a need exists for a new and improved folding firearm that can be folded into an ergonomic, compact shape about a vertical pivot axis. In this regard, the various embodiments of the present invention substantially fulfill at least some of these needs. In this respect, the folding firearm according to the present invention substantially departs from the conventional concepts and designs of the prior art, and in doing so provides an apparatus primarily developed for the purpose of providing a firearm that can be folded into an ergonomic, compact shape about a vertical pivot axis.

SUMMARY OF THE INVENTION

The present invention provides an improved folding firearm, and overcomes the above-mentioned disadvantages and drawbacks of the prior art. As such, the general purpose of the present invention, which will be described subsequently in greater detail, is to provide an improved folding firearm that has all the advantages of the prior art mentioned above.

To attain this, the preferred embodiment of the present invention essentially comprises a first portion including a shoulder stock having a free end butt surface and a trigger assembly including a trigger lever, a second portion including a frame defining a bolt passage, a bolt received in the bolt passage, and a barrel connected to the frame, and the first portion and second portion being pivotally connected to each other to pivot about a pivot axis between an operating position in which the barrel extends in a first direction and the shoulder stock extends in an opposite direction, and a folded position in which the barrel and shoulder stock extend in a common direction. The pivot axis may be perpendicular to a bore axis defined by the barrel, and oriented parallel to a medial plane defined by the firearm, the medial plane being vertical during normal firearm operation.

There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
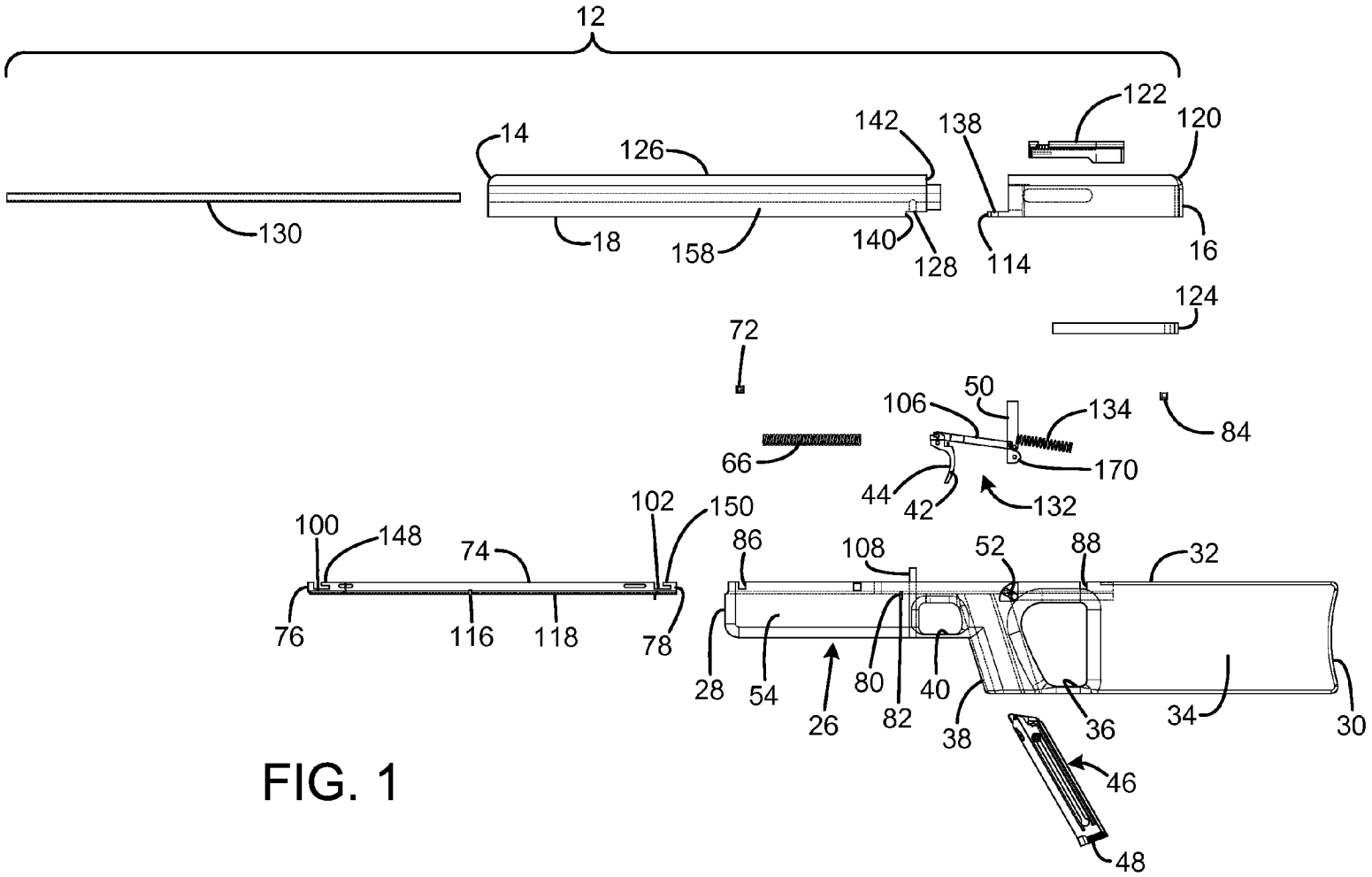
FIG. 1 is a left side exploded view of a current embodiment of the folding firearm constructed in accordance with the principles of the present invention.
Figure 2A:
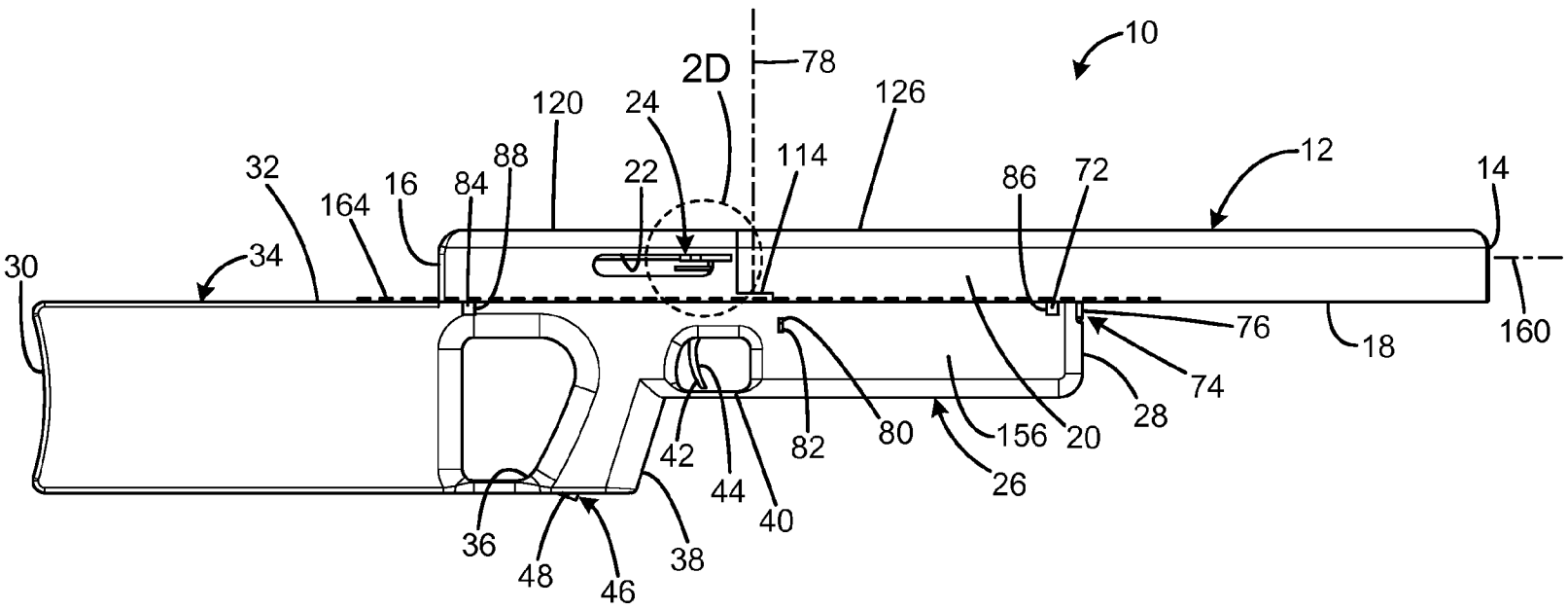
FIG. 2A is a right side view of the folding firearm of FIG. 1 in the unfolded position.
Figure 2B:
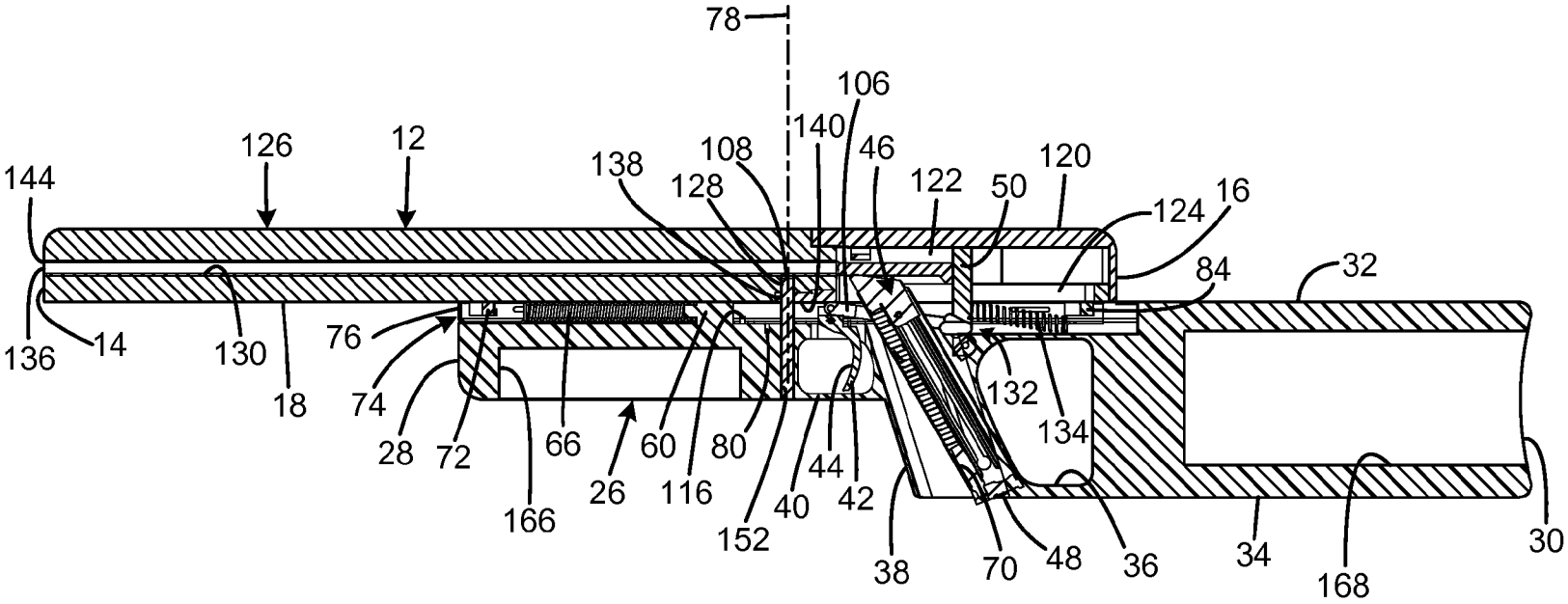
FIG. 2B is a side sectional view of the folding firearm of FIG. 1 in the unfolded position.
Figure 2C:
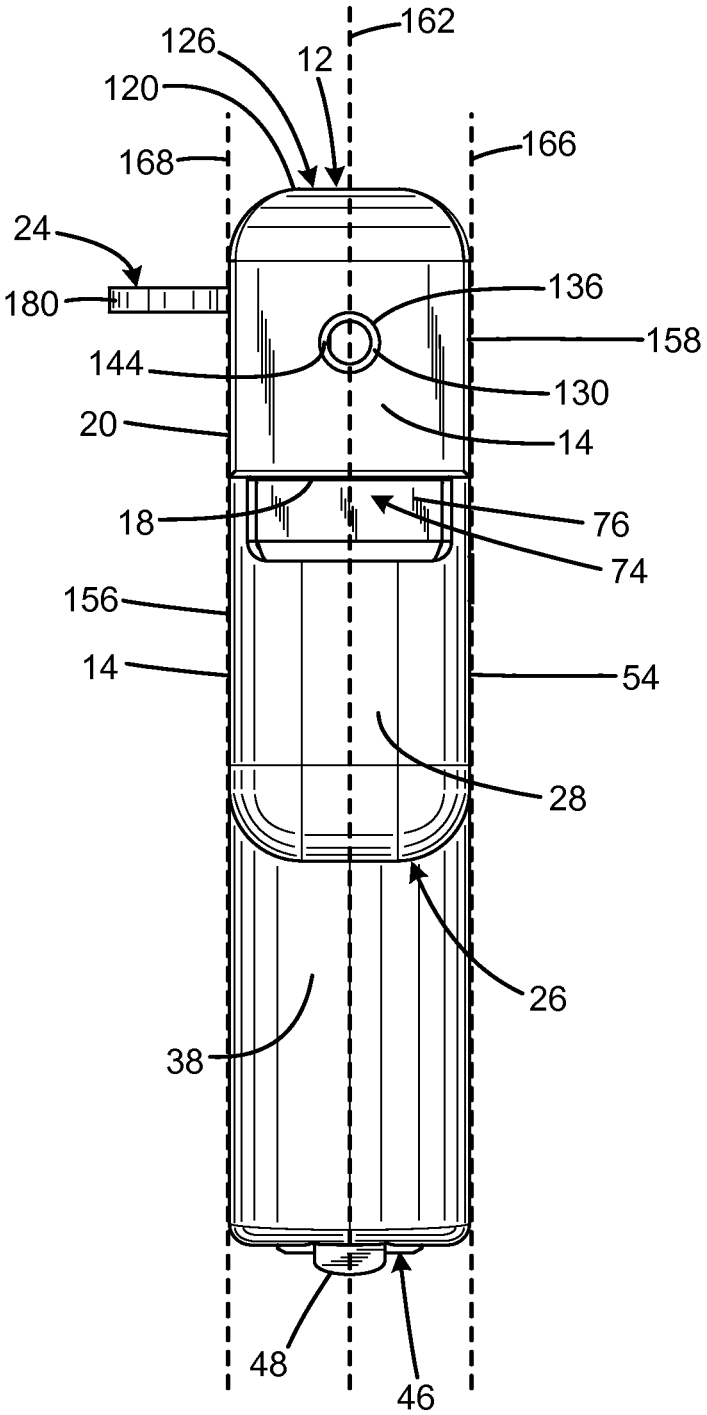
FIG. 2C is a front view of the folding firearm of FIG. 1 in the unfolded position.
Figure 2D:
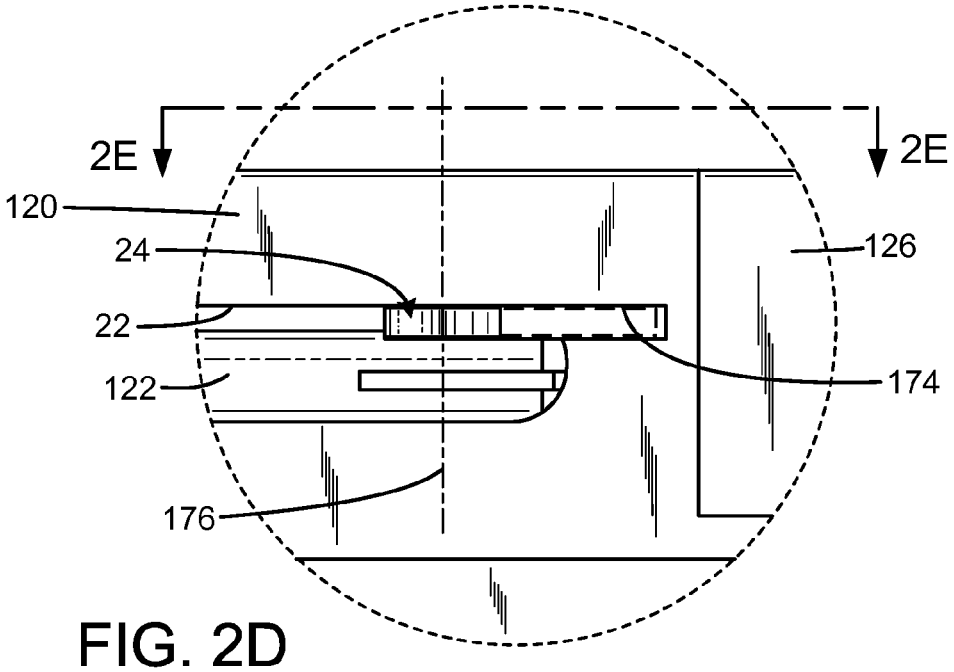
FIG. 2D is an enlarged view taken along circle 2D of FIG. 2A.
Figure 2E:
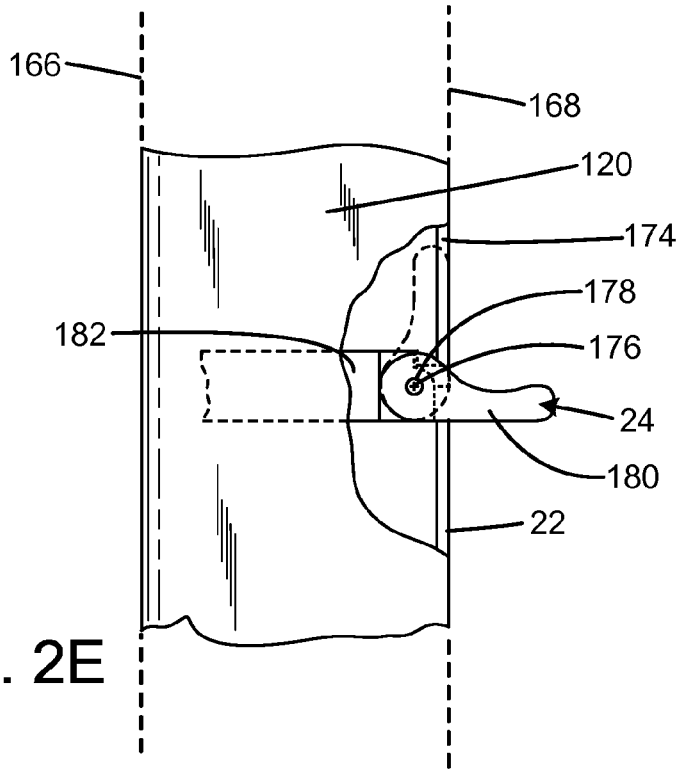
FIG. 2E is a top sectional view taken along lines 2E-2E of FIG. 2D.
Figure 2F:
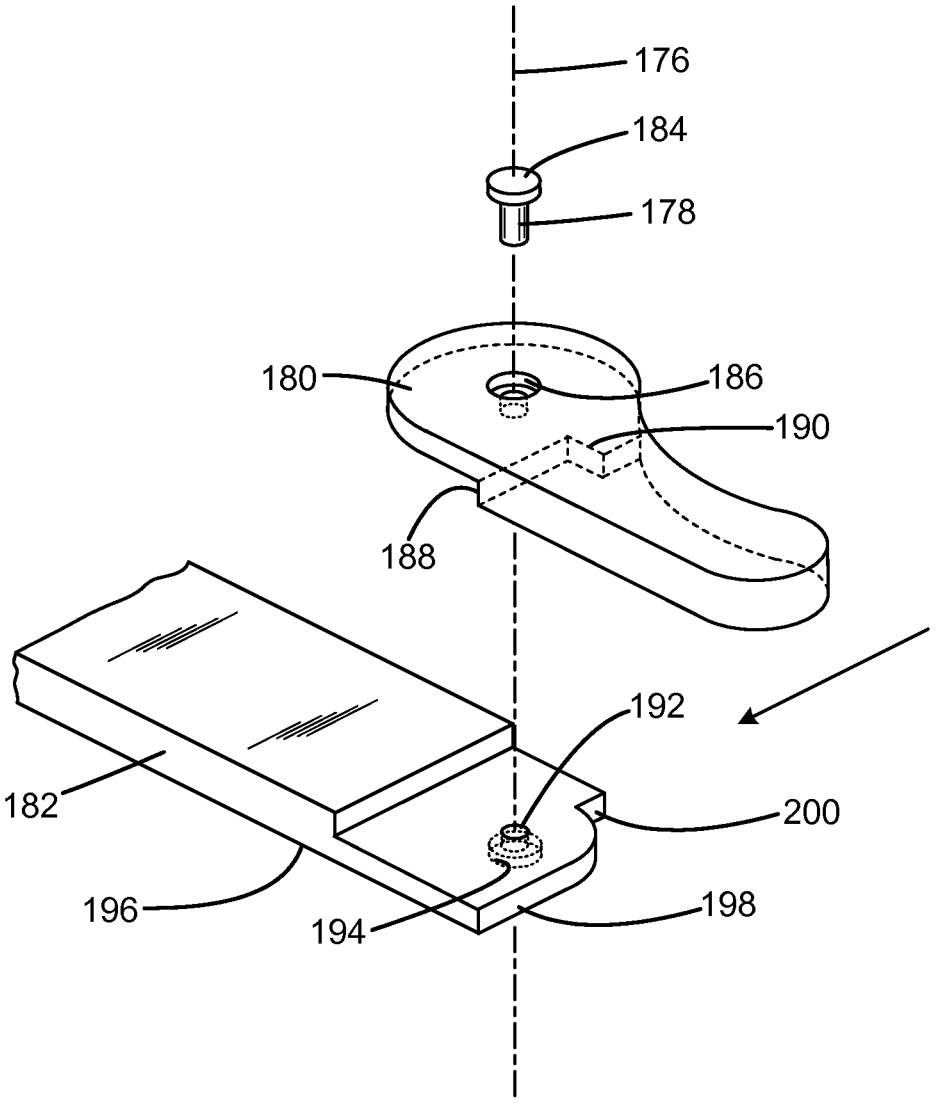
FIG. 2F is a top exploded view of the charging handle of FIG. 2A.

A preferred embodiment of the folding firearm of the present invention is shown and generally designated by the reference numeral 10.

FIGS. 1 & 2A-F illustrate the improved folding firearm of the present invention. More particularly, the folding firearm 10 is a rifle that folds on a pivot axis 78. The folding firearm is shown in the unfolded position. The folding firearm has an upper portion 12 and a lower portion 26 that abut one another at a common interface plane 164 in both the unfolded and folded positions. The common interface plane is perpendicular to the pivot axis in the current embodiment. The folding firearm defines a medial plane 162 that is vertical during normal firearm operation. The medial plane is the primary plane of symmetry of the firearm, as for almost any rifle or handgun. In the current embodiment, the pivot axis is vertical, but the pivot axis can be at other orientations provided the pivot axis passes through the medial plane.

The entire folding firearm (except for the charging handle 24 when the charging handle is unfolded) fits within a limited width envelope of 1.25 inches between parallel side planes 166, 168 both when in the unfolded and folded positions in the current embodiment. However, the charging handle fits within the 1.25 inch envelope when the charging handle is folded. The charging handle is used to cycle the bolt 122 to chamber the first round and to cock the folding firearm 10. Otherwise, the charging handle can remain folded both when the folding firearm is folded for storage and when the folding firearm is unfolded for operation to make the folding firearm as sleek and compact as possible.

The upper portion 12 has a front 14, rear 16, bottom 18, a right side 20, and a left side 158. A front lock boss or tab 72 and rear lock boss or tab 84 protrude downwardly from either side of the bottom of the upper portion. The upper portion is divided into two major parts: an upper receiver 120 and a barrel cover 126.

The upper receiver 120 receives a bolt 122 and has its bottom 18 closed by a bolt cover 124. The upper receiver has a forwardly extending tab 114 that defines a bore 138. The right side 20 of the upper receiver has an aperture that defines an ejection port 22 located rearward of the pivot axis 78. In the current embodiment, the bolt and firing pin (not visible) are standard replacement parts manufactured by Tactical Solutions of Boise, Id. for a Ruger® 10/22® rifle manufactured by Sturm, Ruger & Co., Inc. of Newport, N.H.

The charging handle 24 protrudes outwardly from the ejection port when unfolded, and is received within a slot 174 when folded. The charging handle has a pivoting portion 180 and a non-pivoting portion 182. The pivoting portion is pivotally connected to the non-pivoting portion by a rivet 178 with a head 184. The head is received in a pocket 186 in the pivoting portion, and the remainder of the rivet passes through the pivoting portion and is received within a hole 192 in the non-pivoting portion. A rivet pocket 194 on the bottom 196 of the non-pivoting portion retains the rivet when the rivet is installed. The rivet permits the pivoting portion to pivot with respect to the non-pivoting portion.

The pivoting portion 180 has an unfolded contact surface 188 and a folded contact surface 190. The non-pivoting portion 182 has a corresponding unfolded contact surface 198 and a folded contact surface 200. The contact surfaces limit the range of pivotal motion of the pivoting portion relative to the non-pivoting portion to 90° and prevents the pivoting portion from further pivotal movement when cocking pressure is applied to the charging handle. The arrow in FIG. 2F denotes the direction pressure is applied to the pivoting portion during cocking of the folding firearm.

The barrel cover 126 has a central bore 144 that receives a barrel liner 130. The central bore defines a barrel bore axis 160. The opening of the barrel liner and central bore at the front 14 of the barrel cover defines the muzzle 136 of the folding firearm 10. The bottom 18 of the barrel cover defines an aperture 128 adjacent to the rear 142 of the barrel cover. The bottom of the rear of the barrel cover also defines a step 140 that closely fits the tab 114 on the upper receiver 120. When the tab 114 is fitted to the step during assembly of the folding firearm 10, the aperture 128 is axially registered with the bore 138.

The lower portion 26 has a front 28, a rear 30, a top 32, a left side 54, and a right side 156. A stock 34 is located at the rear of the lower portion. The stock may have a hollow 168 to serve as a storage area. The storage area may be accessible by removable side panels, a bottom panel, or an end panel with peripheral fasteners. An aperture 36 is defined between the stock and a pistol grip 38. The aperture enables a user to grip the pistol grip with his or her right or left hand by inserting the thumb through the aperture. The pistol grip receives a magazine 46, the bottom 48 of which is visible protruding downward from within the pistol grip. A safety lever/hammer lever 52 resides in a recess 172 located above and behind the pistol grip so the hammer lever does not protrude from the left side of the lower portion. A trigger guard 40 is located in front of the pistol grip 38 and protects a trigger 42 therein.

The trigger has a forward facing trigger face 44 and is a component of a trigger group 132. The other components of the trigger group are a disconnector 106, a hammer 50, a hammer spring 134 and a sear 170. The disconnector 106 connects the trigger 42 to the sear 170.

A pivot pin 108 protrudes upward from the lower portion through a slot 110 in the lock channel element. The pivot pin defines the vertical pivot axis 78. In the current embodiment, the pivot pin is inserted through the lower portion from the bottom through bore 152, passes through bore 138 in tab 114 in the upper receiver 120, and is threaded into the barrel cover 126 via aperture 128. Because the pivot pin is inserted into the barrel cover, the upper portion is prevented from inadvertently detaching from the lower portion while pivoting 180°.

The remaining forward portion of the lower portion can have a hollow 166 to serve as a storage area. The storage area may be accessible by removable side panels, a bottom panel, or an end panel with peripheral fasteners. The top of the lower portion defines a pair of front slots 86 and a pair of rear slots 88 on either side. When the folding firearm 10 is in the unfolded position, the front tabs 72 on the upper portion are releasably received in the front slots 86, and the rear tabs 84 are releasably received in the rear slots 88. In the current embodiment, the components of the trigger group are similar in design and function to standard components for a Ruger® 22/45™ pistol manufactured by Sturm, Ruger & Co., Inc. of Newport, N.H.

A lock channel element 74 is slidably received within a channel 56 (shown in FIG. 3) in the top 32 of the lower portion 26. The lock channel element has a front 76, a rear 78, and defines a pair of front retention slots 100 and a pair of rear retention slots 102 on either side. The front and rear retention slots releasably retain the front lock tab 72 and rear lock tab 84 of the upper portion 12 to prevent undesired pivoting of the upper portion when the lock channel element is in the forward, locked position. The front and rear retention slots release the front and rear lock tabs when the lock channel element is in the rearward, unlocked position. When the folding firearm 10 is assembled, the front of the lock channel element is accessible at the front of the lower portion.

In the current embodiment, the folding firearm 10 is adapted to fire .22 LR cartridges. However, the folding firearm can also be adapted to fire 5.7 mm×28 mm cartridges, as well as any other pistol caliber cartridge, from the magazine 46. The folding firearm could also be further adapted to be a bolt-action, single-shot firearm rather than semi-auto firearm, in which case the folding firearm could be adapted to fire any caliber of cartridge.

In the current embodiment, the barrel cover 126 can be made of anodized aluminum or molded thermoset plastic, and the barrel liner is made of chromoly steel. The stock is made of molded plastic, and most of the mechanical parts are made of metal injection molding (MIM) steel in the current embodiment. When the folding firearm 10 is in the unfolded, operating position, the folding firearm has an overall length of 30.50 inches in the current embodiment, and an overall length when in the folded, safe position of 22 inches in the current embodiment.

Figure 3A:
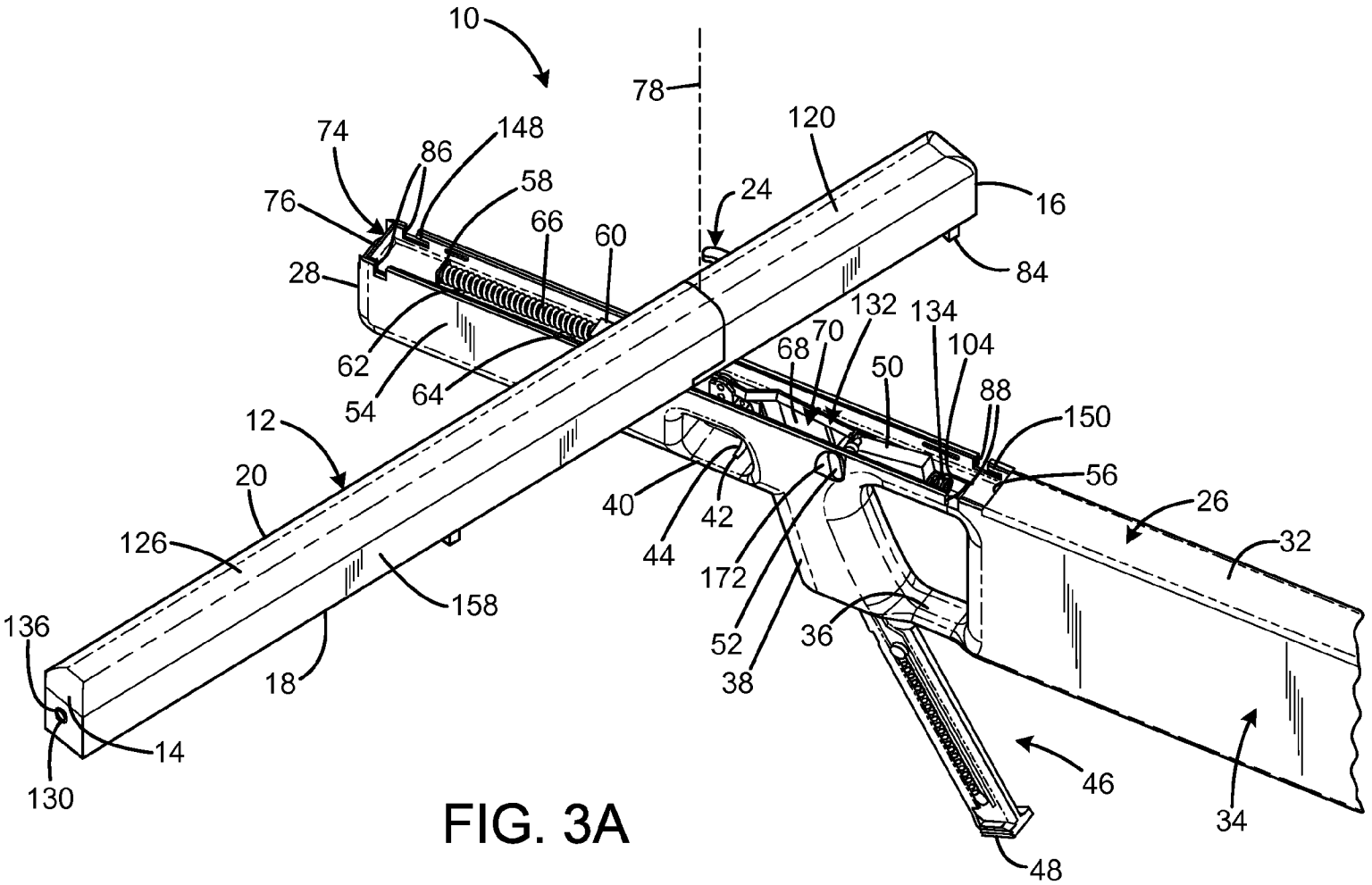
FIG. 3A is a top isometric view of the folding firearm of FIG. 1 in the partially folded position.
Figure 3B:
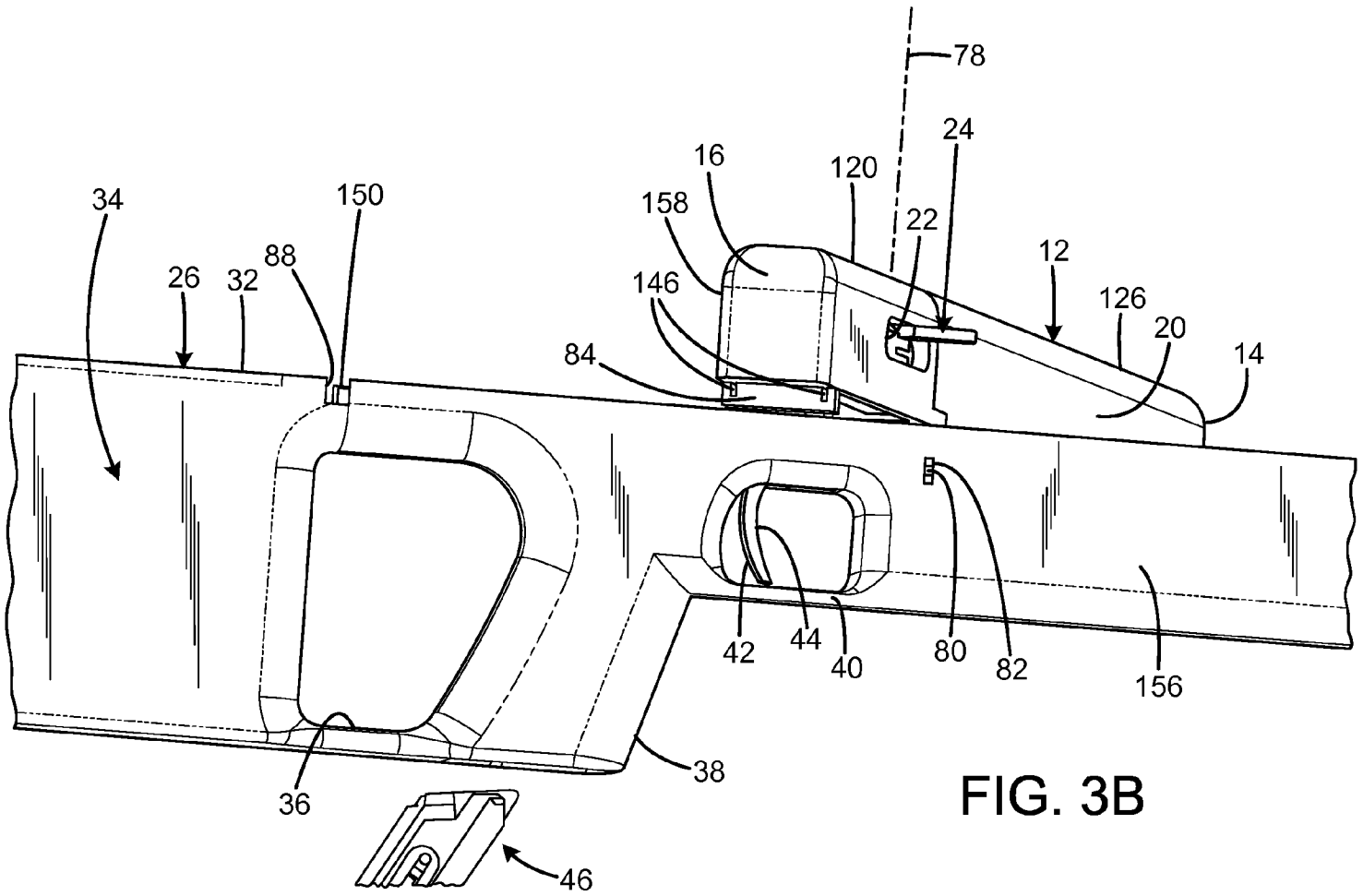
FIG. 3B is a right side isometric view of the folding firearm of FIG. 1 in the partially folded position.

FIGS. 3A & 3B illustrate the improved folding firearm of the present invention. More particularly, the folding firearm 10 is depicted in the partially folded position. In FIGS. 3A & 3B, the upper portion has pivoted in a counterclockwise direction, thereby exposing the top 32 of the lower portion 26. The magazine 46 has been removed prior to folding since the magazine protrudes above the top of the lower portion when installed. The hammer lever 52 has been rotated clockwise to rotate the hammer 50 downward into the channel 56 so no portion of the hammer protrudes above the top 32 of the lower portion 26. The front lock tab 72 and rear lock tab 84 of the upper portion 12 have been released from the front slots 86 and rear slots 88 of the lower portion 26. Once the front and rear lock tabs of the upper portion have been released from the front and rear slots, the upper portion is free to pivot about the vertical pivot axis 78. The front and rear lock tabs have slots (only slots 146 in the rear lock tab are visible) that receive protrusions 148 and 150, respectively, on the lock channel element 74 to releasably secure the upper portion to the lower portion when the lock channel element is in the forward, locked position.

The top 32 of the lower portion 26 that is located in front of the stock 34 defines a channel 56. The channel 56 slidably receives the lock channel element 74. A tab 58 protrudes upward from the lock channel element, which also has a slot 62 located immediately rearward of the tab 58. A boss 60 protrudes upward from the top of the lower portion and passes through a slot 64 in the lock channel element. A main spring 66 is captured between the tab 58 and the boss 60. The main spring urges the lock channel element forward until contact between the rear of the slot 64 with the rear of the boss limits further forward movement.

The lock channel element 74 has an aperture 68 that is registered with a magazine well 70 in the pistol grip 38 when the lock channel element is in the forwardmost position. The lock channel element has a hammer slot 104 that is located rearward of the apertures 68. A gap between the rear 78 of the lock channel element and the rear of the channel 56 when the lock channel element is in the forwardmost position permits the lock channel element to slide rearward into contact with the rear of the channel when sufficient force is applied to the front 76 of the lock channel element to compress the main spring 66. A rectangular lock bar 80, which is received within a slot 82 in the sides of the lower portion 26, pops upward into the slot 116 to hold the lock channel element in the rearmost position. Lowering the lock bar releases the lock channel element to return to the forwardmost position.

Figure 4:
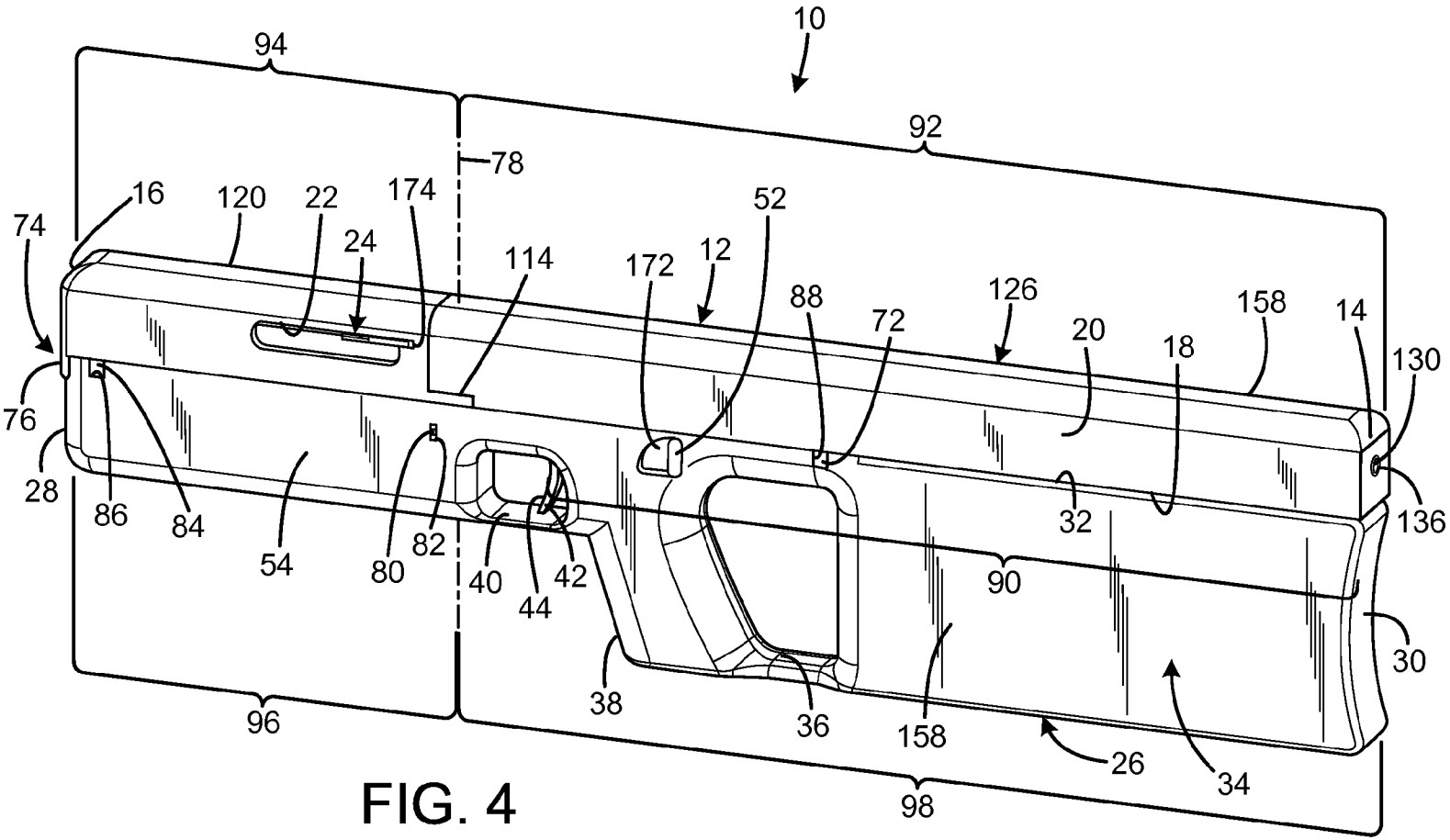
FIG. 4 is a left isometric view of the folding firearm of FIG. 1 in the fully folded position.
Figure 5A:
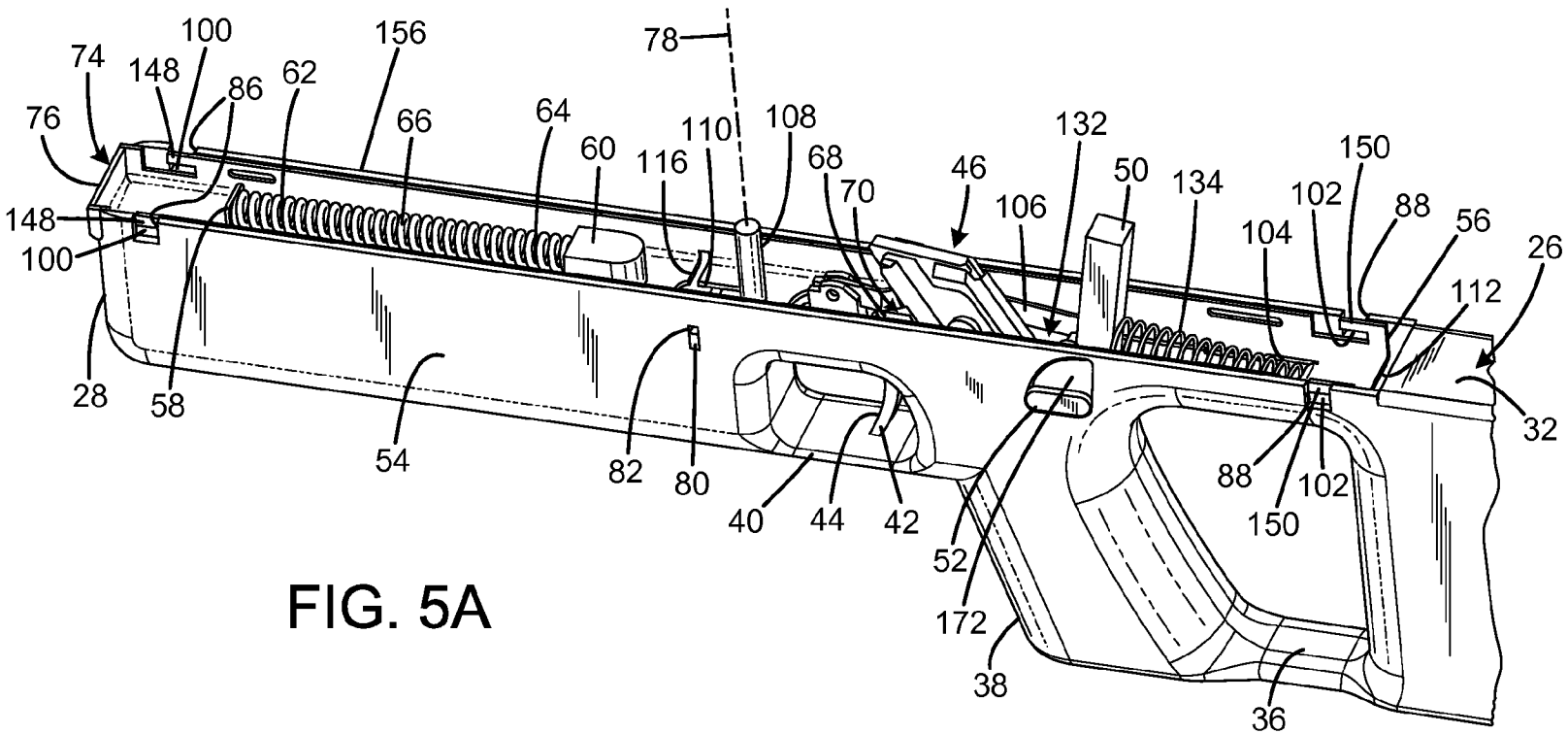
FIG. 5A is a top isometric partial view of the lower portion and lock channel element of FIG. 1 with the lock channel element in the forward locked position.
Figure 5B:
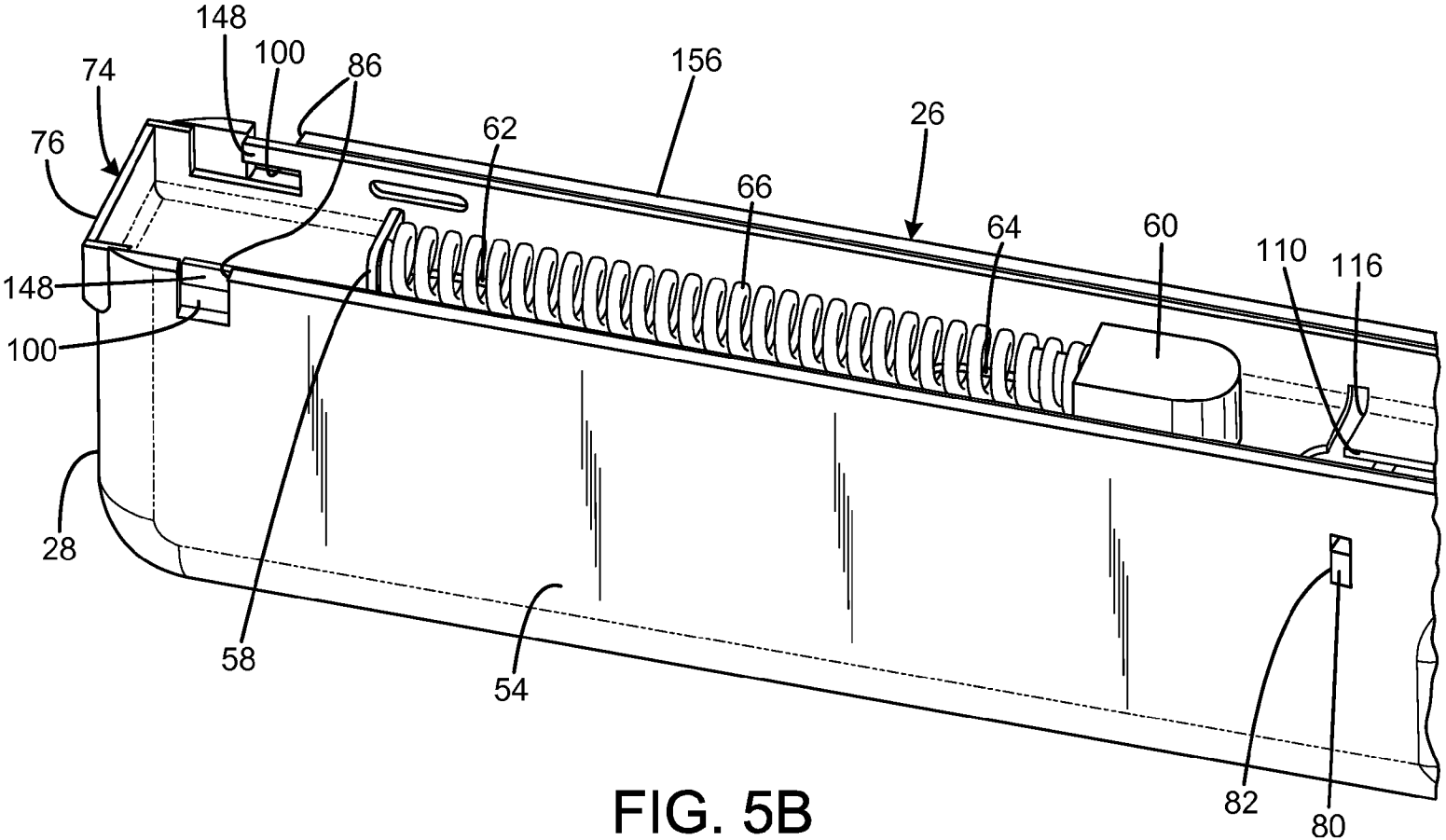
FIG. 5B is an enlarged top isometric partial view of the front of the lower portion and lock channel element of FIG. 1 with the lock channel element in the forward locked position.
Figure 5C:
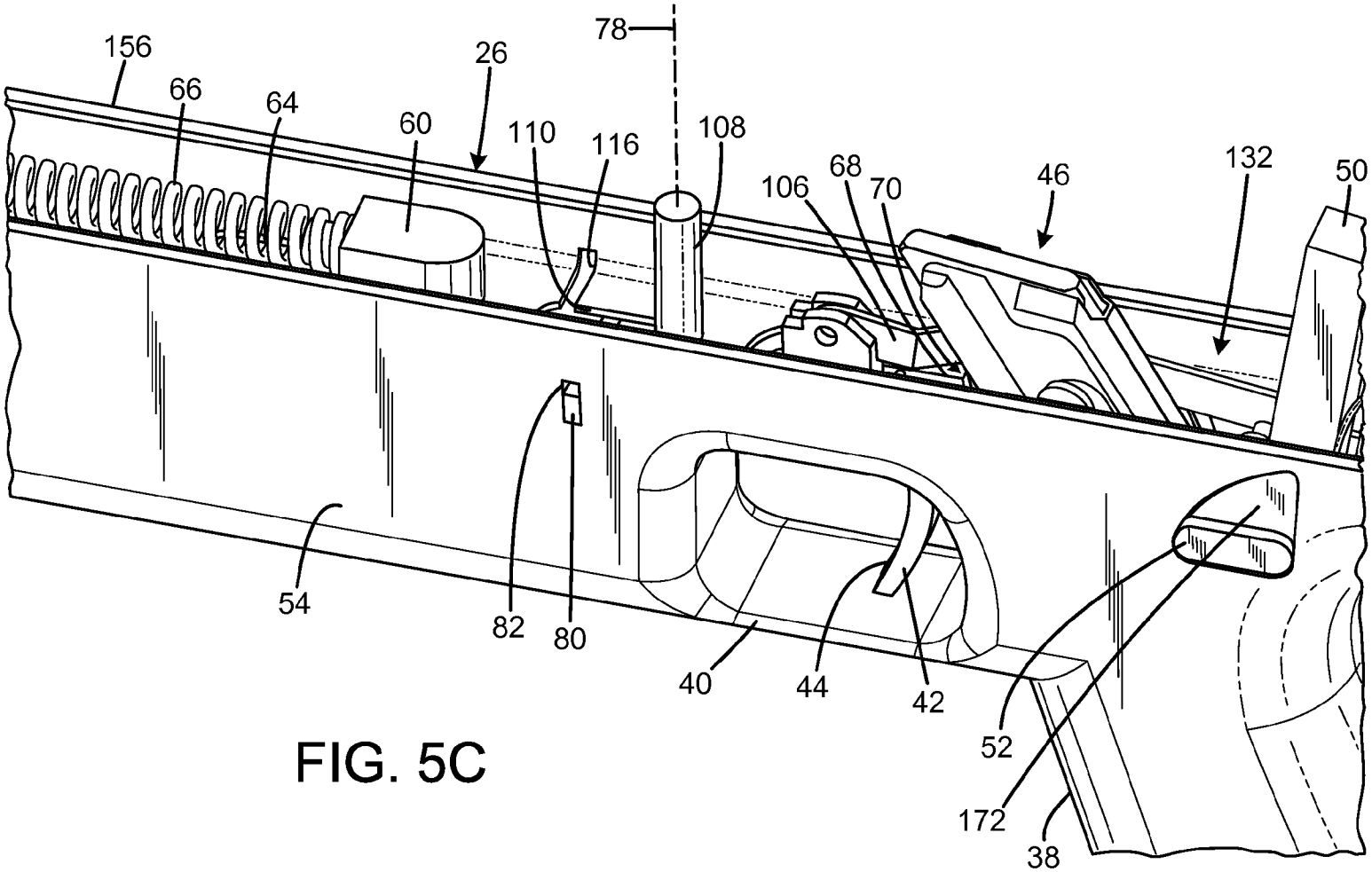
FIG. 5C is an enlarged top isometric partial view of the middle of the lower portion and lock channel element of FIG. 1 with the lock channel element in the forward locked position.
Figure 5D:
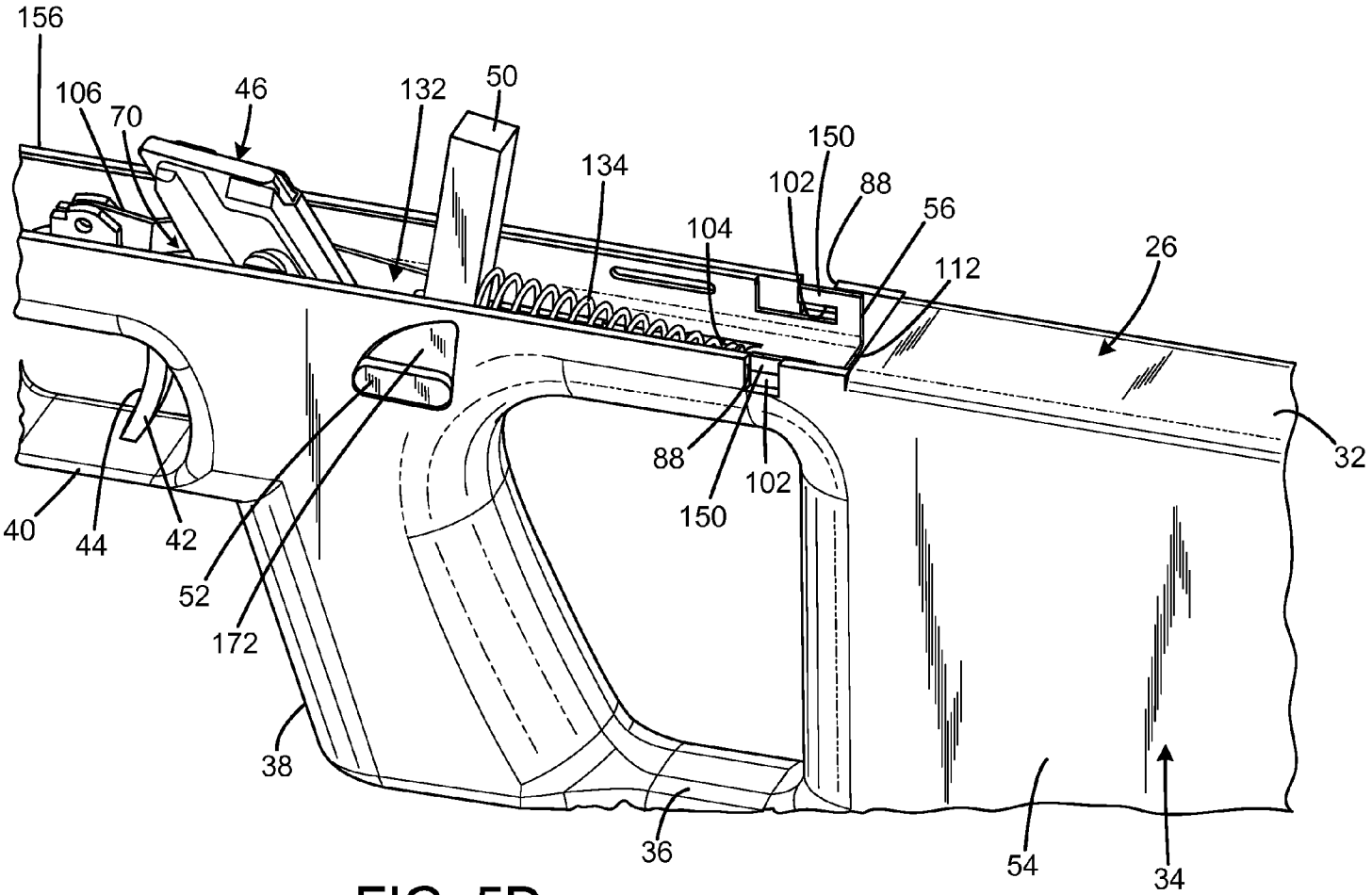
FIG. 5D is an enlarged top isometric partial view of the rear of the lower portion and lock channel element of FIG. 1 with the lock channel element in the forward locked position.
Figure 6A:
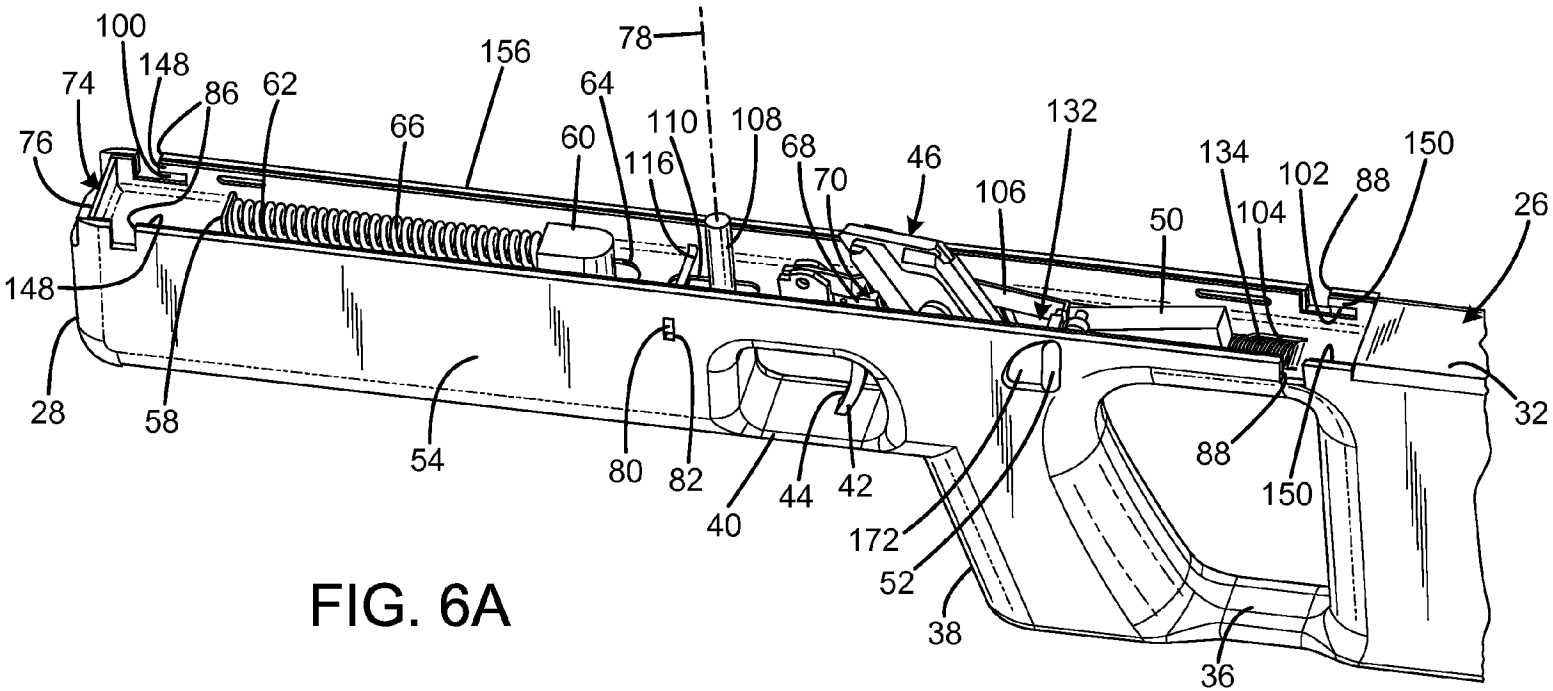
FIG. 6A is a top isometric partial view of the lower portion and lock channel element of FIG. 1 with the lock channel element in the rearward unlocked position.
Figure 6B:
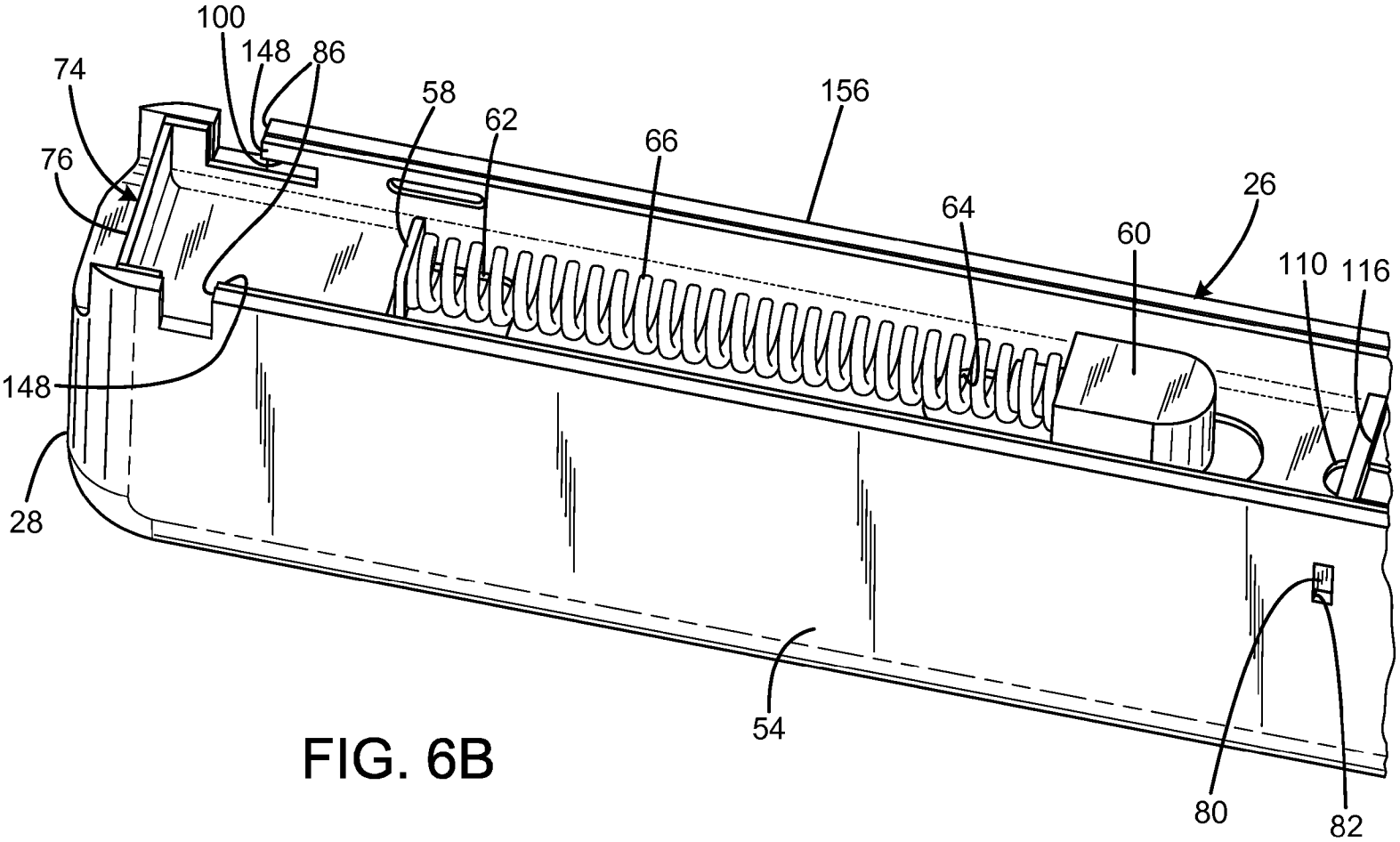
FIG. 6B is an enlarged top isometric partial view of the front of the lower portion and lock channel element of FIG. 1 with the lock channel element in the rearward unlocked position.
Figure 6C:
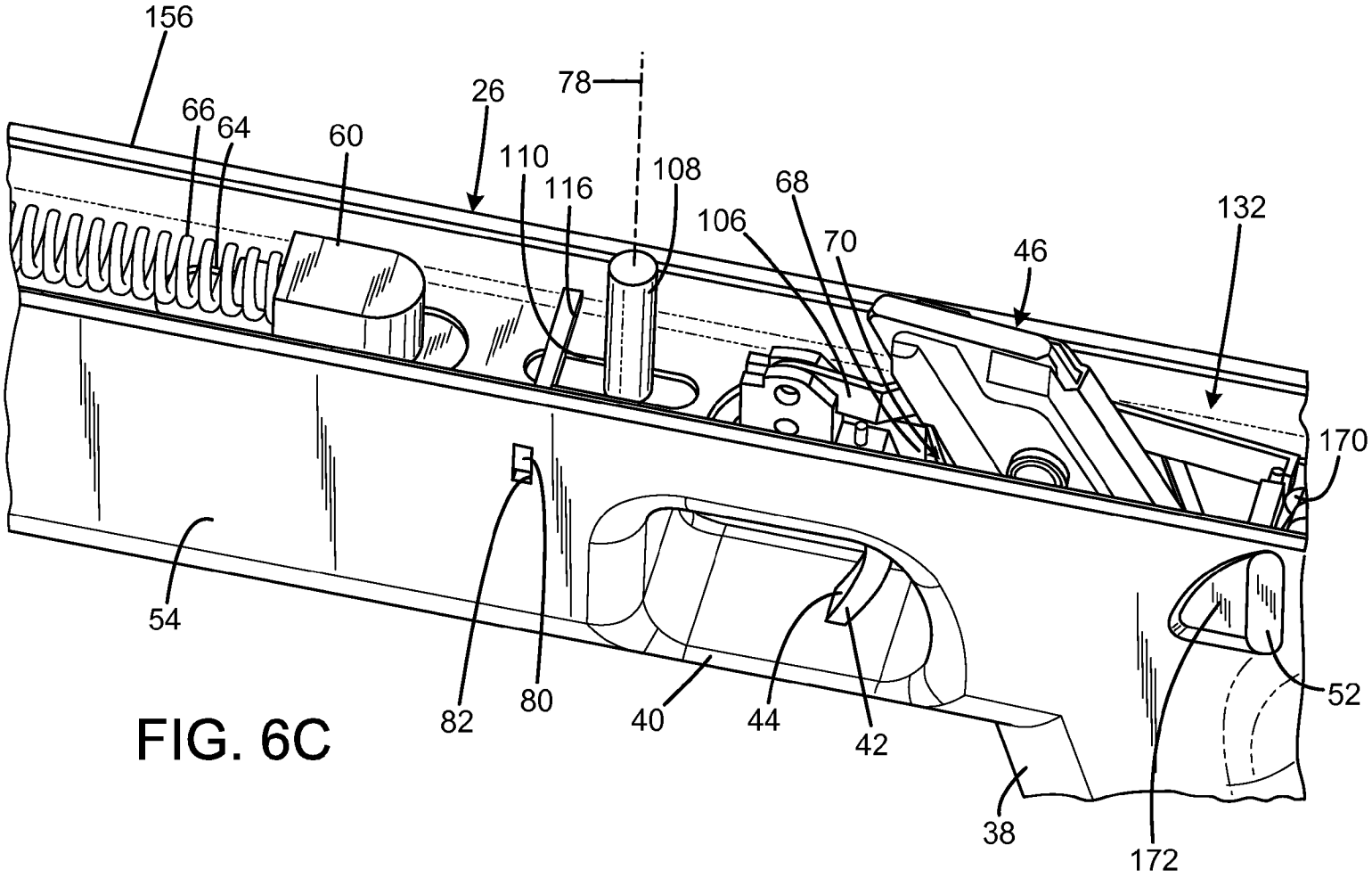
FIG. 6C is an enlarged top isometric partial view of the middle of the lower portion and lock channel element of FIG. 1 with the lock channel element in the rearward unlocked position.
Figure 6D:
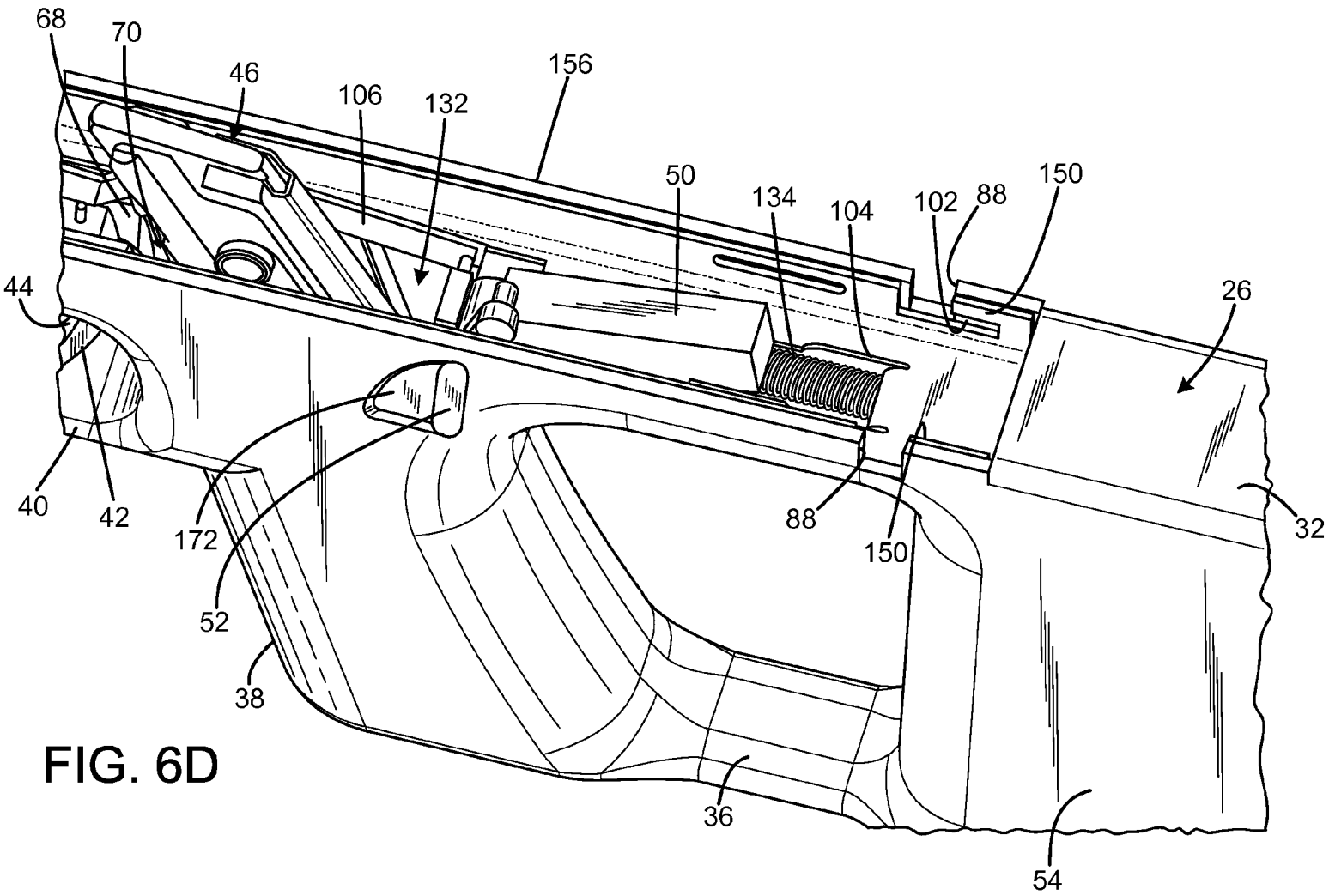
FIG. 6D is an enlarged top isometric partial view of the rear of the lower portion and lock channel element of FIG. 1 with the lock channel element in the rearward unlocked position.

FIG. 4 illustrates the folding firearm 10 of the present invention. More particularly, the folding firearm 10 is shown in the fully folded position. The vertical pivot axis 78 is located such that the distance from the pivot axis to the front 14 of the upper portion 12 is equivalent to the distance from the pivot axis to the rear 30 of the lower portion 26. The pivot axis is also located such that the distance from the pivot axis to the rear 16 of the upper portion is equivalent to the distance from the pivot axis to the front 28 of the lower portion. These distances enable the front of the upper portion to be flush with the rear of the lower portion and the rear of the upper portion to be flush with the front of the lower portion to create a pleasing, compact appearance while still enabling the folding firearm's barrel to be at least 16 inches and the length of pull 90 measured from the front face 44 of the trigger 42 to the rear of the lower portion to be 13.5 to 14 inches. In the current embodiment, the distance from the pivot axis to the front of the upper portion and the distance from the pivot axis to the rear of the lower portion is 15.25 inches. In the current embodiment, the distance from the pivot axis to the rear of the upper portion and the distance from the pivot axis to the front of the lower portion is 6.75 inches.

FIGS. 5A-5D illustrate the lower portion 26 of the present invention. More particularly, the lock channel element 74 is installed in the channel 56 in the top 32 of the lower portion and is in the forward, locked position. The hammer lever 52 has been rotated forward which allows the hammer 50 to extend to the raised, operational position. The lock channel element is shown in the forward, locked position. The protrusions 148, 150 on the lock channel element are positioned to releasably secure the front and rear lock tabs on the upper portion 12 (not shown) within the front and rear slots 86, 88. The lock bar 80 is disengaged from the slot 116 in the lock channel element in this position and remains so until the lock channel element is pushed sufficiently rearward. The hammer spring 134 is attached to the lock channel element so when the lock channel element is pushed rearward, the hammer spring also moves rearward and ceases to press against the hammer 50. This movement of the hammer spring enables the hammer to be rotated rearward by the hammer lever 52. The rearward rotation of the hammer lever stows the hammer within the lower portion to facilitate folding and unfolding of the folding firearm 10.

Figure 7:
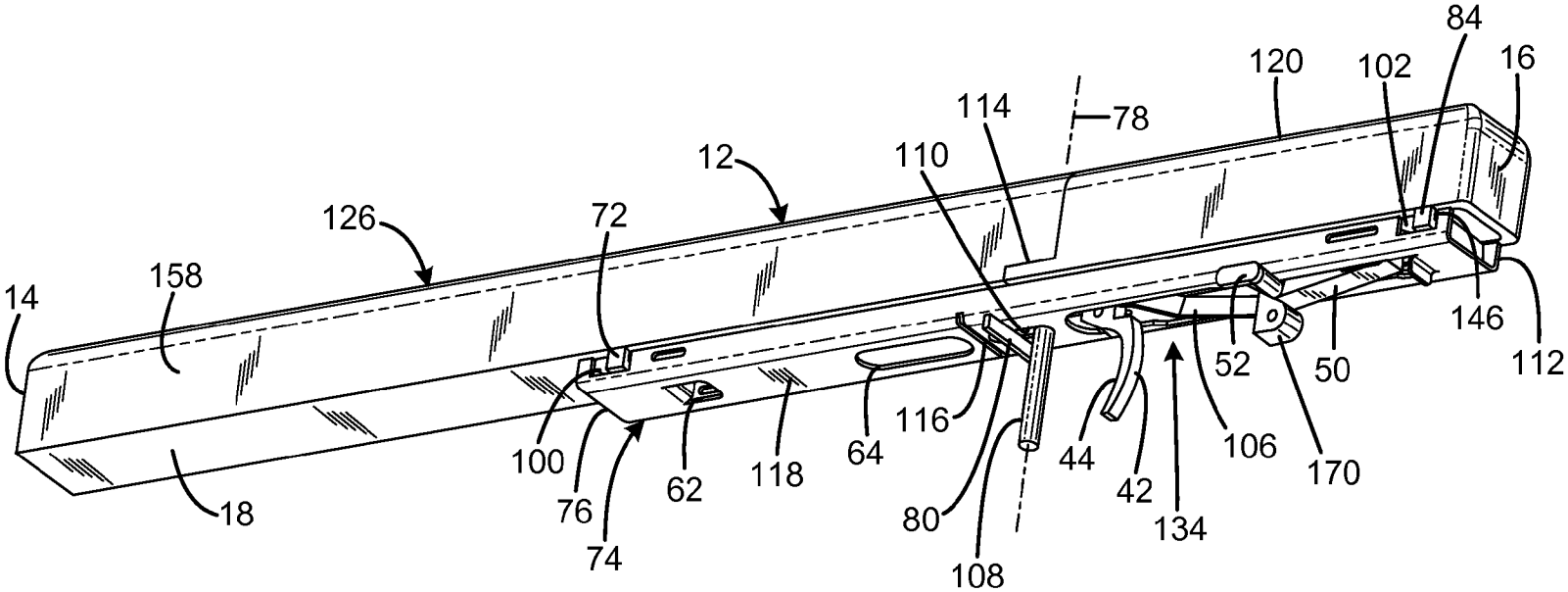
FIG. 7 is a bottom isometric view of the upper portion and lock channel element of FIG. 1.

FIGS. 6A-6D illustrate the lower portion 26 of the present invention. More particularly, the lock channel element 74 is installed in the channel 56 in the top 32 of the lower portion and is in the rearward, unlocked position. The front 76 of the lock channel element has been pushed rearward to compress the main spring 66 between the tab 58 and boss 60. The rearward movement of the lock channel element withdraws the protrusions 148, 150 from the front and rear slots 86, 88 in the lower portion 26 and the slots (146 is shown in FIG. 3B, and 146, 154 are shown in FIG. 7) in the front and rear lock tabs 72, 84. The front and rear lock tabs can then be withdrawn from the front and rear slots by rotating the upper portion 12 about the pivot pin 108. When the lock channel element is pushed rearward, the lock bar 80 springs up within slot 82 into the slot 116 on the bottom 118 of the lock channel element. A hidden spring (not visible) is recessed into the lower portion below the lock bar. The lock bar holds the lock channel element in the rearward, locked position while the hammer 50 is rotated rearward by the hammer lever 52. Slight rearward pressure on the lock channel element is applied while pushing down on the lock bar to allow the lock channel element to return to its forward, locked position.

FIG. 7 illustrates the upper portion 12 of the present invention. More particularly, the protrusions 148, 150 on the lock channel element 74 are shown releasably retaining the front lock tab 72 and rear tab 84 by engagement with slots 154, 146, respectively. The rectangular lock bar 80 is shown in position to engage with slot 116 in the bottom 118 of the lock channel element when lock channel element 74 is slid to the rearmost position.

In the context of the specification, the terms "rear" and "rearward" and "front" and "forward" have the following definitions: "rear" or "rearward" means in the direction away from the muzzle of the firearm, while "front" or "forward" means in the direction towards the muzzle of the firearm.

While a current embodiment of the folding firearm has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm comprising:

a first portion including a shoulder stock having a flee end butt surface and a trigger assembly including a trigger lever;

a second portion including a flame defining a bolt passage, a bolt received in the bolt passage, and a barrel connected to the flame;

the first portion and second portion being pivotally connected to each other to pivot about a pivot axis between an operating position in which the barrel extends in a first direction and the shoulder stock extends in an opposite direction, and a folded position in which the barrel and shoulder stock extend in a common direction; and wherein the pivot axis is perpendicular to a bore axis defined by the barrel, and oriented parallel to a vertical plane defined through the first and second portions of the firearm.

2. The firearm of claim 1 wherein the first portion and second portion abut each other at a common interface plane perpendicular to the pivot axis.

3. The firearm of claim 2 wherein substantially all of the first portion is below the interface plane and substantially all of the second portion is above the interface plane, when the firearm is oriented in a normal firing position with the barrel horizontal.

4. The firearm of claim 1 wherein the butt surface is a first selected distance from the pivot axis, the second portion having a muzzle end separated from the pivot axis by the first selected distance.

5. The firearm of claim 1 wherein the first portion has a forward end surface opposite the shoulder stock and a second selected distance from the pivot axis, the second portion has a rear end opposite the muzzle end and separated from the pivot axis by the second selected distance.

6. The firearm of claim 1 wherein the first portion includes a reciprocating latch operable to slide between an unlocked position and a locked position, the latch including engagement elements operably engaged to the second portion when the latch is in the locked position and the second portion is in one of the operating position and the folded position, and wherein the second portion is free to pivot with respect to the first portion between the operating position and the folded position when the latch is in the unlocked position.

7. The firearm of claim 6 wherein the engagement elements include elongated pins, wherein the second portion defines a plurality of engagement apertures registered with the engagement pins when the second portion is in one of the operating position and the folded position, and wherein the pins occupy the apertures when the latch is in the locked position to secure the first and second portion against pivoting.

8. The firearm of claim 6 wherein the latch is an elongated element extending forward and aft of the pivot axis.

9. The firearm of claim 1 wherein the first portion and the second portion have a common length, such that their respective ends are flush with each other to provide a minimal overall length when in the folded position.

10. The firearm of claim 1 wherein the first portion defines a magazine well adapted to receive a magazine.

11. The firearm of claim 10 wherein the second portion defines a magazine space proximate a rear chamber end of the barrel, and operable to receive an upper feed portion of a magazine in the magazine well when the firearm is in the operating position.

12. The firearm of claim 10 wherein the first portion includes a handgrip defining the magazine well.

13. The firearm of claim 1 wherein the first portion has an upper surface and the second portion has a lower surface, the upper surface and lower surfaces overlaying each other when the firearm is in the folded position.

14. The firearm of claim 13 wherein the upper surface entirely covers the lower surface when the firearm is in the folded position.

15. The firearm of claim 1 wherein the firearm has an overall height when the firearm is in the operating position, the folded position, and in an intermediate transitional position between the operating position and the folded position.

16. The firearm of claim 1 wherein the firearm has an overall width when the firearm is in the operating position, and in the folded position.

17. A firearm comprising:

a first portion including a shoulder stock having a free end butt surface and a trigger assembly including a trigger lever;

a second portion including a barrel;

the first portion and second portion being pivotally connected to each other to pivot about a pivot axis between an operating position in which the barrel extends in a first direction and the shoulder stock extends in an opposite direction, and a folded position in which the barrel and shoulder stock extend in a common direction;

the pivot axis being vertical when the firearm is in a normal firing position with the trigger extending substantially downward and the barrel aimed horizontally; and wherein the pivot axis is perpendicular to a bore axis defined by the barrel, and oriented parallel to a vertical plane defined through the first and second portions of the firearm.

18. The firearm of claim 17 wherein the first portion and the second portion abut each other at a common horizontal plane when the firearm is in a normal firing position with the trigger extending substantially downward and the barrel aimed horizontally.

19. A firearm comprising:

a first portion including a shoulder stock having a free end butt surface and a trigger assembly including a trigger lever;

a second portion including a barrel;

the first portion and second portion being pivotally connected to each other to pivot about a pivot axis between an operating position in which the barrel extends in a first direction and the shoulder stock extends in an opposite direction, and a folded position in which the barrel and shoulder stock extend in a common direction;

the first portion and second portion abutting each other at a common horizontal plane when the firearm is in a normal firing position with the trigger extending substantially downward and the barrel aimed horizontally; and wherein the pivot axis is perpendicular to a bore axis defined by the barrel, and oriented parallel to a vertical plane defined through the first and second portions of the firearm.

20. The firearm of claim 13 wherein the upper surface provides access to a storage compartment defined in the lower portion.

21. The firearm of claim 1 wherein the firearm has an overall length of greater than 26 inches when in the operating position.

22. The firearm of claim 1 wherein the firearm has an overall length when folded that is less than or equal to 22 inches.

23. The firearm of claim 1 further comprising:

the first portion and the second portion each having engagement elements forward of the pivot axis and engagement elements rearward of pivot axis;

wherein the engagement elements comprise latch pins and holes; and wherein the engagement elements are separated by the same distance from the pivot axis such that a forward latch pin engages a forward hole when the firearm is in an operating position, and the forward latch pin engages a rear hole when the firearm is in a folded position.

24. The firearm of claim 1, wherein the pivot axis passes through a medial plane defined by the firearm.

25. The firearm of claim 2 further comprising a lever that operably engages the hammer to retract the hammer below the common interface plane to enable pivoting of the firearm.

26. The firearm of claim 2, wherein bosses are the only elements of the upper portion that extend below the common interface plane.

27. The firearm of claim 1, wherein the entire folding firearm fits within a limited width envelope of 1.25 inches between parallel side planes both when in the unfolded and folded positions.

* * * * *